US011717874B2

(12) United States Patent
Xu et al.

(10) Patent No.: US 11,717,874 B2
(45) Date of Patent: Aug. 8, 2023

(54) PRECISION COMPENSATION MECHANISM OF FULL-AUTOMATIC BIDIRECTIONAL FLANGING MACHINE

(71) Applicants: NANJING UNIVERSITY OF POSTS AND TELECOMMUNICATIONS, Nanjing (CN); NANJNG NANYOU INSTITUTE OF INFORMATION TECHNOVATION CO., LTD, Nanjing (CN)

(72) Inventors: Fengyu Xu, Nanjing (CN); Sen Yang, Nanjing (CN); Jingjin Shen, Nanjing (CN); Zixin Chen, Nanjing (CN); Guoping Jiang, Nanjing (CN)

(73) Assignees: NANJING UNIVERSITY OF POSTS AND TELECOMMUNICATIONS, Nanjing (CN); NANJNG NANYOU INSTITUTE OF INFORMATION TECHNOVATION CO., LTD, Nanjing (CN)

( * ) Notice: Subject to any disclaimer, the term of this patent is extended or adjusted under 35 U.S.C. 154(b) by 187 days.

(21) Appl. No.: 17/334,992

(22) Filed: May 31, 2021

(65) Prior Publication Data

US 2021/0283673 A1 Sep. 16, 2021

(51) Int. Cl.

| | |
|---|---|
| ***B21D 37/20*** | (2006.01) |
| ***B21D 5/00*** | (2006.01) |
| ***B21D 5/02*** | (2006.01) |
| ***B21D 43/00*** | (2006.01) |

(52) U.S. Cl.

CPC ..... *B21D 37/20* (2013.01); *B21D 5/004* (2013.01); *B21D 5/0209* (2013.01); *B21D 43/003* (2013.01)

(58) Field of Classification Search

CPC ..... B21D 5/002; B21D 43/003; B21D 37/14

See application file for complete search history.

(56) References Cited

U.S. PATENT DOCUMENTS 2,703,129 A * 3/1955 Smith ..... B21D 5/01 72/415
2015/0298191 A1* 10/2015 Da Silva Alves .... B30B 15/041 72/389.3
2016/0271671 A1* 9/2016 Aigner ..... B21D 5/002 72/389.3

FOREIGN PATENT DOCUMENTS

CN 106890871 A * 6/2017 ..... B21D 5/02
DE 10143406 A1 * 4/2003 ..... F16B 5/0233
JP H09300432 A * 11/1997 ..... B29C 47/22

* cited by examiner

*Primary Examiner* — Debra M Sullivan
*Assistant Examiner* — Matthew Stephens
(74) *Attorney, Agent, or Firm* — CBM Patent Consulting, LLC

(57) ABSTRACT

A precision compensation mechanism of a full-automatic bidirectional flanging machine comprises an upper die X-direction fine adjustment assembly, an upper die Y-direction fine adjustment assembly, a lower die X-direction fine adjustment assembly and a lower die Y-direction fine adjustment assembly, wherein the fine adjustment assemblies each comprise N adjusting threaded sleeves, N adjusting screws and a threaded sleeve rotation driving device; wherein the N adjusting threaded sleeves are threaded into an upper opening or a lower opening of a C-shaped flanging beam along the length direction of an upper die or a lower die; the outer wall surfaces of the N adjusting threaded sleeves are threaded into the upper opening or the lower opening of the C-shaped flanging beam to form N screw thread pairs I with the thread pitch of P1.

6 Claims, 5 Drawing Sheets

PRECISION COMPENSATION MECHANISM OF FULL-AUTOMATIC BIDIRECTIONAL FLANGING MACHINE

This application claims priority to Chinese Application No. CN202011079801.3 filed on 10 Oct. 2020, the entire contents of each of which are hereby incorporated by reference.

TECHNICAL FIELD

The present invention relates to the field of numerically controlled flanging processing, in particular to a precision compensation mechanism of a full-automatic bidirectional flanging machine.

BACKGROUND

The numerically-controlled flanging machine has the production efficiency that can at least reach about 3 times that of the traditional three-point bending processing equipment, with high degree of automation and high flexibility. The numerically controlled flanging machine has an extremely rapid development in recent years, and is a hot spot for the development of the field of numerically controlled sheet metal processing equipment, which is considerable in the market demand.

In the conventional three-point bending processing equipment, the stress deformation of a mechanical structure can be compensated by a certain compensation measure, so that the precision can be ensured, for example, as described in the Chinese Utility Model Patent Application No. 201520679683.8 entitled "BENDER ANGLE COMPENSATION WORKSTATION AND BENDER THEREOF".

However, unlike the conventional three-point bending processing equipment, the mechanical structure of the numerically controlled flanging machine is deformed by superposing the deformation amounts in two directions, so that a deformation curve 80 as shown in FIG. 1 is formed. Therefore, it is difficult to compensate. The stress deformation of the mechanical structure has a great effect on bending precision, and in general, a deformation of about 0.05 mm corresponds to an angle error of 1°. Therefore, the bending precision can be increased only by increasing the structural dimension or by reducing the bending load, which is obviously unreasonable.

In addition, when multiple-variety and small-batch processing is carried out, or the same workpiece is bent for a plurality of times with a greatly-changed bending length, the load of each bending is different, and the caused elastic deformations are different. Therefore, it is necessary to develop a mechanism that can automatically compensate according to actual working conditions.

SUMMARY

The technical problem to be solved by the present invention is to provide a precision compensation mechanism of a full-automatic bidirectional flanging machine that automatically compensates the deformation of flanging dies, aiming at the defects of the prior art. Furthermore, the deformation compensation curve is formed by superposing the deformation amounts in the X direction and the Y direction, which is not a straight line but a curve, so that the present invention is high in compensation precision, and is suitable for the flanging dies with longer lengths.

In order to solve the above technical problem of the prior art, the present invention provides the following technical solution.

A precision compensation mechanism of a full-automatic bidirectional flanging machine comprises an upper die X-direction fine adjustment assembly, an upper die Y-direction fine adjustment assembly, a lower die X-direction fine adjustment assembly and a lower die Y-direction fine adjustment assembly, wherein the bidirectional flanging machine comprises a C-shaped flanging beam, an upper die and a lower die, wherein the upper die is mounted on an upper opening of the C-shaped flanging beam through several sets of fastening screws, and the lower die is mounted on a lower opening of the C-shaped flanging beam through several sets of fastening screws;

the upper die X-direction fine adjustment assembly can finely adjust the upper die along the X direction, and the upper die Y-direction fine adjustment assembly can finely adjust the upper die along the Y direction;

the lower die X-direction fine adjustment assembly can finely adjust the lower die along the X direction, and the lower die Y-direction fine adjustment assembly can finely adjust the lower die along the Y direction;

the upper die X-direction fine adjustment assembly, the upper die Y-direction fine adjustment assembly, the lower die X-direction fine adjustment assembly and the lower die Y-direction fine adjustment assembly each comprise N adjusting threaded sleeves, N adjusting screws and a threaded sleeve rotation driving device, wherein $N \geq 2$, the N adjusting threaded sleeves are threaded into the upper opening or the lower opening of the C-shaped flanging beam along the length direction of the upper die or the lower die, the outer wall surfaces of the N adjusting threaded sleeves are threaded into the upper opening or the lower opening of the C-shaped flanging beam to form N screw thread pairs I with the assumed thread pitch of P1;

each of the N adjusting threaded sleeves is threaded with an adjusting screw, and the tip end of each adjusting screw is threaded into the upper die or the lower die; the inner wall surfaces of the N adjusting threaded sleeves are threaded into the upper die or the lower die to form N screw thread pairs II with the assumed thread pitch of P2, and P1>P2.

The adjusting threaded sleeves can rotate under the action of the corresponding threaded sleeve rotation driving device, thereby finely adjusting the upper die or the lower die along the X direction and/or the Y direction.

Fine adjustment amount of the upper die or the lower die along the X direction and/or the Y direction is $T=n*(P1-P2)$, wherein n is the rotation number of the adjusting threaded sleeves.

N different fine adjustment quantities T are obtained by adjusting N thread pitches P1 and N thread pitches P2, thereby realizing curve compensation along the X direction and/or the Y direction.

The threaded sleeve rotation driving device is a movable rack and a linear driving device of the movable rack. The outer wall surface of the free end of each adjusting threaded sleeve is provided with a gear, the movable rack is engaged with the gears of the N adjusting threaded sleeves, and the movable rack can slide linearly along the length direction of the upper die or the lower die under the action of the linear driving device of the movable rack.

The upper opening of the C-shaped flanging beam is provided with a top L-shaped mounting groove, an upper die mounting groove and an upper inner side L-shaped mounting groove, wherein the top L-shaped mounting groove is arranged at the top of the upper opening and configured for mounting the upper die Y-direction fine adjustment assembly, and each adjusting threaded sleeve and each adjusting screw of the upper die Y-direction fine adjustment assembly are positioned in the Y direction; the upper die mounting groove is arranged on the lower outer side of the upper opening and configured for threading the upper die; the upper inner side L-shaped mounting groove is arranged on the lower inner side of the upper opening and configured for mounting the upper die X-direction fine adjustment assembly, and each adjusting threaded sleeve and each adjusting screw of the upper die X-direction fine adjustment assembly are positioned in the X direction.

The lower opening of the C-shaped flanging beam is provided with a bottom L-shaped mounting groove, a lower die mounting groove and a lower inner side L-shaped mounting groove, wherein the bottom L-shaped mounting groove is arranged at the bottom of the lower opening and configured for mounting the lower die Y-direction fine adjustment assembly, and each adjusting threaded sleeve and each adjusting screw of the lower die Y-direction fine adjustment assembly are positioned in the Y direction; the lower die mounting groove is arranged on the upper outer side of the lower opening and configured for threading the lower die; the lower inner side L-shaped mounting groove is arranged on the upper inner side of the lower opening and configured for mounting the lower die X-direction fine adjustment assembly, and each adjusting threaded sleeve and each adjusting screw of the lower die X-direction fine adjustment assembly are positioned in the X direction.

The present invention has the following beneficial effects:

1. The present invention can automatically compensate the deformation of flanging dies. The upper die X-direction fine adjustment assembly and the upper die Y-direction fine adjustment assembly automatically compensate the upper die along the X direction and/or the Y direction, and the lower die X-direction fine adjustment assembly and the lower die Y-direction fine adjustment assembly automatically compensate the lower die along the X direction and/or the Y direction.

2. N different fine adjustment amounts T are obtained by adjusting N thread pitches P1, N thread pitches P2 and the rotation number n of the adjusting threaded sleeve, thereby realizing curve instead of straight-line compensation along the X direction and/or the Y direction. In addition, the deformation compensation curve is formed by superposing the deformation amounts in the X direction and the Y direction, so that the present invention is high in compensation precision, and is suitable for the flanging dies with longer lengths.

Figure 1:
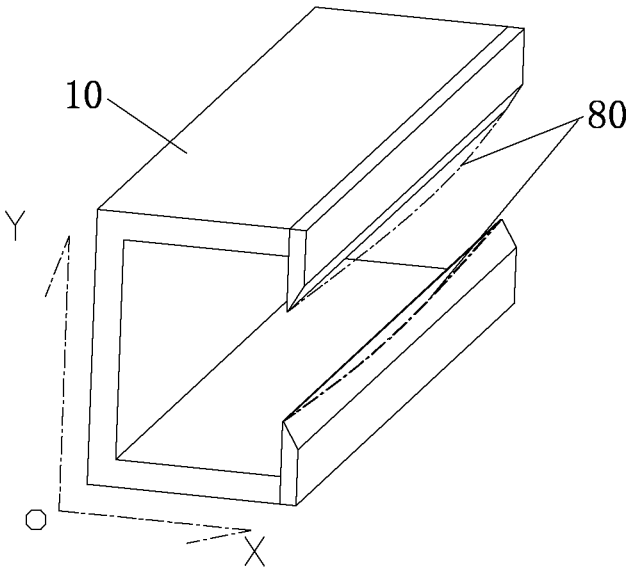
FIG. 1 shows a schematic diagram of a deformation curve of a flanging die during the flanging process in the prior art.

10 is a C-shaped flanging beam;

11 is an upper opening; 111 is a top L-shaped mounting groove; 112 is an upper die mounting groove; 113 is an upper inner side L-shaped mounting groove;

12 is a lower opening; 121 is a bottom L-shaped mounting groove; 122 is a lower die mounting groove; 123 is a lower inner side L-shaped mounting groove;

20 is an upper die; 21 is a fastening screw; 30 is a lower die;

40 is an upper die X-direction fine adjustment assembly;

50 is an upper die Y-direction fine adjustment assembly;

60 is a lower die X-direction fine adjustment assembly;

70 is a lower die Y-direction fine adjustment assembly;

71 is a movable rack; 72 is an adjusting threaded sleeve; 721 is a gear; 73 is an adjusting screw; 74 is a screw thread pair I; 75 is a screw thread pair II; 76 is a gear and rack engaging part;

80 is a deformation curve.

DETAILED DESCRIPTION

The present invention will be further described in detail with reference to the drawings and specific preferred embodiments.

In the description of the present invention, it should be understood that the terms "left side", "right side", "upper part", "lower part" and the like refer to orientations or positions based on those shown in the drawings. The terms are only for the convenience and simplification of the description of the present invention, rather than indicating or implying that the device or element referred to must have a specific orientation, be constructed and operated in a specific orientation. The terms "first" and "second" do not represent the importance of components, and therefore cannot be construed as limiting the present invention. The specific dimensions used in the present example are only for illustrating the technical solution without limiting the protection scope of the present invention.

Figure 2:
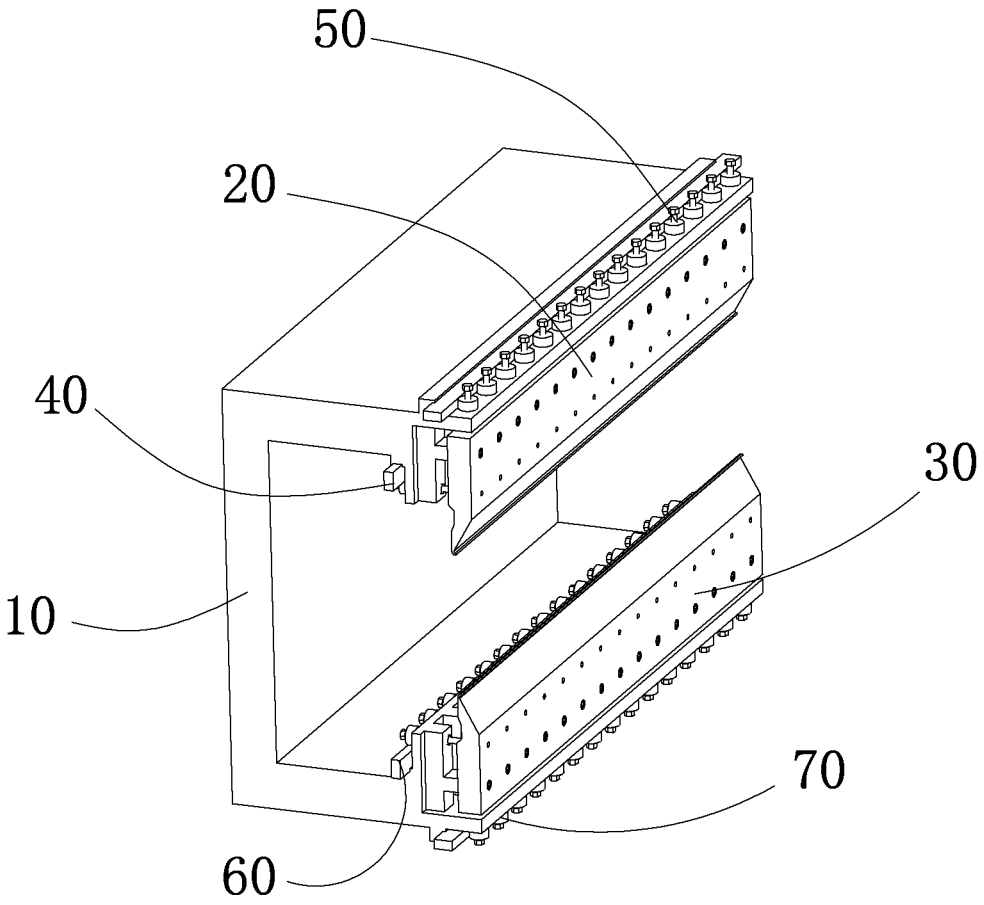
FIG. 2 shows a structural schematic diagram of a precision compensation mechanism of a full-automatic bidirectional flanging machine according to the present invention.
Figure 4:
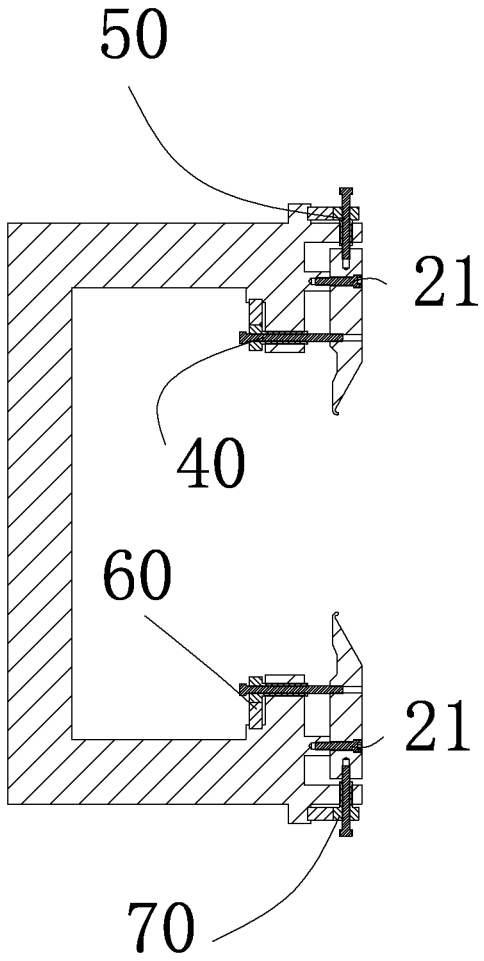
FIG. 4 shows a longitudinal-section diagram of FIG. 2.

As shown in FIGS. 2 and 4, the precision compensation mechanism of the full-automatic bidirectional flanging machine comprises an upper die X-direction fine adjustment assembly 40, an upper die Y-direction fine adjustment assembly 50, a lower die X-direction fine adjustment assembly 60 and a lower die Y-direction fine adjustment assembly 70.

The bidirectional flanging machine comprises a C-shaped flanging beam 10, an upper die 20, and a lower die 30. The upper die is mounted on an upper opening of the C-shaped flanging beam through several sets of fastening screws 21, and the lower die is mounted on a lower opening of the C-shaped flanging beam through several sets of fastening screws 21.

The upper die and the lower die are connected with the C-shaped flanging beam 10 in a way that ensures the connection rigidity and provides a certain small deformation allowance when the fine adjustment assemblies perform fine adjustment actions (with a certain degree of flexibility instead of absolute rigidity that results in a compensation failure).

The upper die X-direction fine adjustment assembly can finely adjust the upper die along the X direction, and the upper die Y-direction fine adjustment assembly can finely adjust the upper die along the Y direction;

the lower die X-direction fine adjustment assembly can finely adjust the lower die along the X direction, and the lower die Y-direction fine adjustment assembly can finely adjust the lower die along the Y direction.

Figure 3:
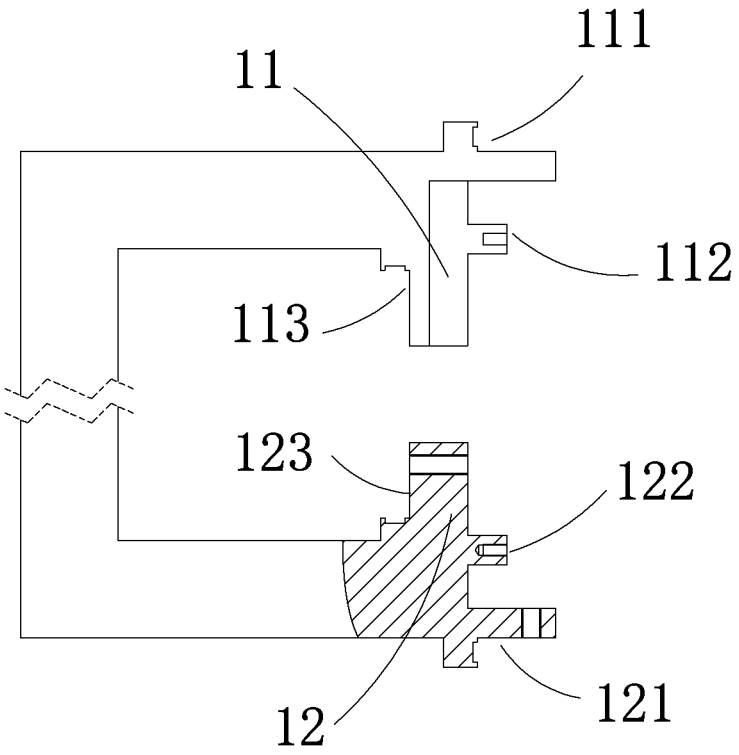
FIG. 3 shows a structural schematic diagram of a flanging beam according to the present invention.

As shown in FIG. 3, the upper opening 11 of the C-shaped flanging beam is provided with a top L-shaped mounting groove 111, an upper die mounting groove 112, and an upper inner side L-shaped mounting groove 113.

The top L-shaped mounting groove is arranged at the top of the upper opening and configured for mounting the upper die Y-direction fine adjustment assembly, and each adjusting threaded sleeve and each adjusting screw of the upper die Y-direction fine adjustment assembly are positioned in the Y direction.

The upper die mounting groove is arranged on the lower outer side of the upper opening and configured for threading the upper die.

The upper inner side L-shaped mounting groove is arranged on the lower inner side of the upper opening and configured for mounting the upper die X-direction fine adjustment assembly, and each adjusting threaded sleeve and each adjusting screw of the upper die X-direction fine adjustment assembly are positioned in the X direction.

The lower opening 12 of the C-shaped flanging beam is provided with a bottom L-shaped mounting groove 121, a lower die mounting groove 122 and a lower inner side L-shaped mounting groove 123, wherein the bottom L-shaped mounting groove is arranged at the bottom of the lower opening and configured for mounting the lower die Y-direction fine adjustment assembly, and each adjusting threaded sleeve and each adjusting screw of the lower die Y-direction fine adjustment assembly are positioned in the Y direction; the lower die mounting groove is arranged on the upper outer side of the lower opening and configured for mounting the lower die in a threaded manner; the lower inner side L-shaped mounting groove is arranged on the upper inner side of the lower opening and configured for mounting the lower die X-direction fine adjustment assembly, and each adjusting threaded sleeve and each adjusting screw of the lower die X-direction fine adjustment assembly are positioned in the X direction.

Figure 5:
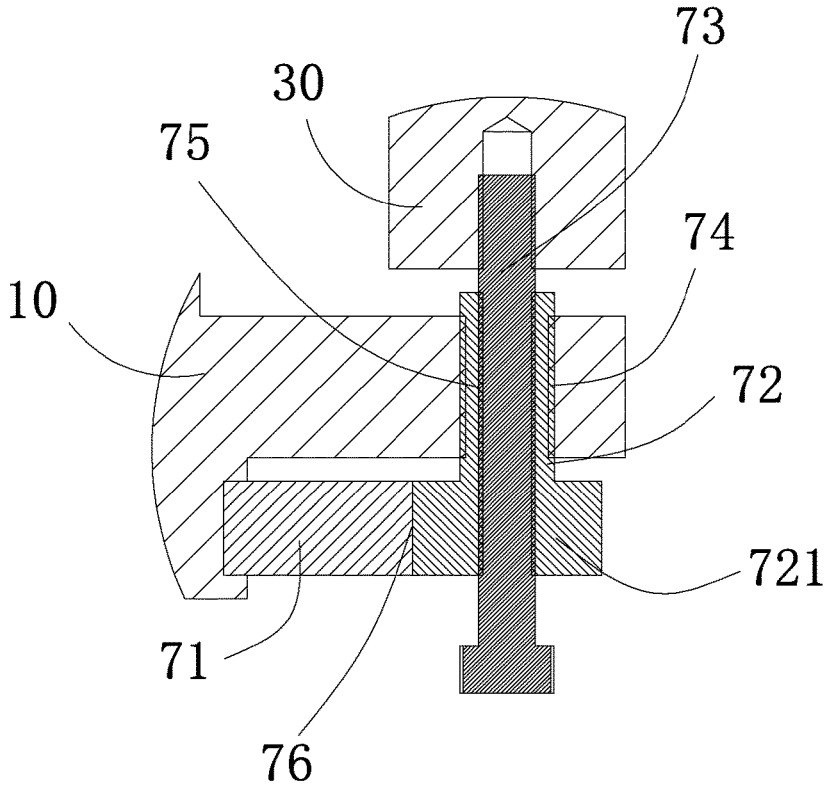
FIG. 5 shows a specific structural schematic diagram of a lower die fine adjustment assembly.

As shown in FIG. 5, the upper die X-direction fine adjustment assembly, the upper die Y-direction fine adjustment assembly, the lower die X-direction fine adjustment assembly and the lower die Y-direction fine adjustment assembly each comprise N adjusting threaded sleeves 72, N adjusting screws 73 and a threaded sleeve rotation driving device, wherein N≥2.

The N adjusting threaded sleeves are threaded into the upper opening or the lower opening of the C-shaped flanging beam along the length direction of the upper die or the lower die. The outer wall surfaces of the N adjusting threaded sleeves are threaded into the upper opening or the lower opening of the C-shaped flanging beam to form N screw thread pairs I 74 with the assumed thread pitch of P1.

Each of the N adjusting threaded sleeves is threaded with an adjusting screw, and the tip end of each adjusting screw is threaded into the upper die or the lower die. The inner wall surfaces of the N adjusting threaded sleeves are threaded into the upper die or the lower die to form N screw thread pairs II 75 with the assumed thread pitch of P2, and P1>P2.

The adjusting threaded sleeves can rotate under the action of the corresponding threaded sleeve rotation driving device, thereby finely adjusting the upper die or the lower die along the X direction and/or the Y direction.

The threaded sleeve rotation driving device is preferably a movable rack 71 and a linear driving device of the movable rack. The outer wall surface of the free end of each adjusting threaded sleeve is provided with a gear 721, and the movable rack is engaged with the gears of the N adjusting threaded sleeves to form a gear and rack engaging part 76. The movable rack can slide linearly along the length direction of the upper die or the lower die under the action of the linear driving device of the movable rack.

Fine adjustment amount of the upper die or the lower die along the X direction and/or the Y direction is T=n*(P1-P2), wherein n is the rotation number of the adjusting threaded sleeves.

Figure 6:
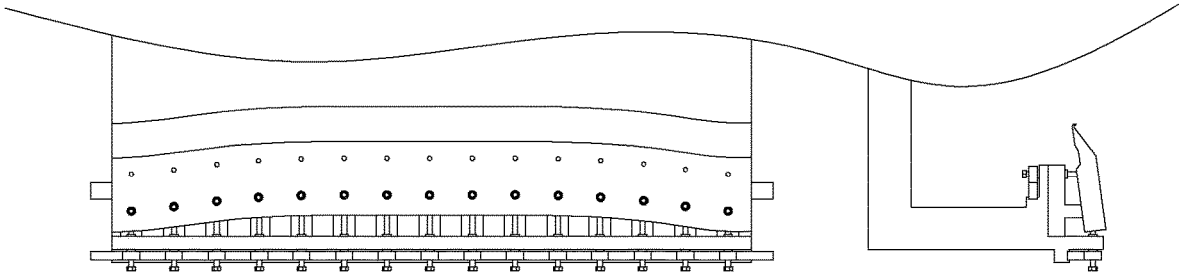
FIG. 6 shows a schematic diagram of a compensation principle of a precision compensation mechanism of a full-automatic bidirectional flanging machine according to the present invention.

Since the deformation curve along the die direction is not uniform, the compensation amount of each fine adjustment assembly along the die direction is different. Different combinations of P1 and P2 are needed, so that a compensation curve (instead of a straight line) is obtained. As shown in FIG. 6, N different fine adjustment quantities T are obtained by adjusting N thread pitches P1 and N thread pitches P2, thereby realizing curve compensation along the X direction and/or the Y direction.

Although the preferred embodiments of the present invention have been described in detail, the present invention is not limited to the details of the embodiments. Various equivalent changes may be made within the technical concept of the present invention, and these equivalent changes are within the technical scope of the present invention.

What is claimed is:

1. A precision compensation mechanism of a full-automatic bidirectional flanging machine, comprising:

an upper die X-direction fine adjustment assembly, an upper die Y-direction fine adjustment assembly, a lower die X-direction fine adjustment assembly and a lower die Y-direction fine adjustment assembly, wherein the bidirectional flanging machine comprises a C-shaped flanging beam, an upper die and a lower die, wherein the upper die is mounted on an upper opening of the C-shaped flanging beam through several sets of fastening screws, and the lower die is mounted on a lower opening of the C-shaped flanging beam through several sets of fastening screws;

the upper die X-direction fine adjustment assembly can finely adjust the upper die along the X direction, and the upper die Y-direction fine adjustment assembly can finely adjust the upper die along the Y direction;

the lower die X-direction fine adjustment assembly can finely adjust the lower die along the X direction, and the lower die Y-direction fine adjustment assembly can finely adjust the lower die along the Y direction;

the upper die X-direction fine adjustment assembly, the upper die Y-direction fine adjustment assembly, the lower die X-direction fine adjustment assembly and the lower die Y-direction fine adjustment assembly each comprise N adjusting threaded sleeves, N adjusting screws and a threaded sleeve rotary actuator, wherein N>2;

the N adjusting threaded sleeves of the upper die X-direction fine adjustment assembly and the N adjusting threaded sleeves of the upper die Y-direction fine adjustment assembly are threaded into the upper opening of the C-shaped flanging beam, and the N adjusting threaded sleeves of the lower die X-direction fine adjustment assembly and the N adjusting threaded sleeves of the lower die Y-direction fine adjustment assembly are threaded into the lower opening of the C-shaped flanging beam;

the outer wall surfaces of the N adjusting threaded sleeves of the upper die X-direction fine adjustment assembly and the outer wall surfaces of the N adjusting threaded sleeves of the upper die Y-direction fine adjustment assembly are threaded into the upper opening of the C-shaped flanging beam, and the outer wall surfaces of the N adjusting threaded sleeves of the lower die X-direction fine adjustment assembly and the outer wall surfaces of the N adjusting threaded sleeves of the lower die Y-direction fine adjustment assembly are threaded into the lower opening of the C-shaped flanging beam to form N screw thread pairs I with an assumed thread pitch of P1;

each of the N adjusting threaded sleeves is threaded with one of said N adjusting screws, and the tip end of each adjusting screw is threaded into the upper die or the lower die; the outside wall surfaces of the N adjusting screws are threaded into inner wall surfaces of the N adjusting threaded sleeves and also connected to the upper die or the lower die to form N screw threaded pairs II with the assumed thread pitch of P2, and P1>P2;

the adjusting threaded sleeves for each fine adjusting assembly are configured to be rotated by the corresponding threaded sleeve rotary actuator, thereby finely adjusting the upper die or the lower die along the X direction and/or the Y direction.

2. The precision compensation mechanism of the full-automatic bidirectional flanging machine according to claim 1, wherein fine adjustment amount of the upper die or the lower die along the X direction and/or the Y direction is T=n*(P1−P2), wherein n is the number of full rotations of the adjusting threaded sleeves.

3. The precision compensation mechanism of the full-automatic bidirectional flanging machine according to claim 2, wherein N different fine adjustment amounts T are obtained by adjusting N thread pitches P1 and N thread pitches P2, thereby realizing curve compensation along the X direction and/or the Y direction.

4. The precision compensation mechanism of the full-automatic bidirectional flanging machine according to claim 1, wherein each of the threaded sleeve rotary actuators is a movable rack and a linear driving device of the movable rack; the outer wall surface of the free end of each adjusting threaded sleeve is provided with a gear, the movable rack for the threaded sleeve rotary actuator of a fine adjusting assembly is engaged with the gears of the N adjusting threaded sleeves of the fine adjusting assembly, and the movable rack can slide linearly along the length direction of the upper die or the lower die under the action of the linear driving device of the movable rack.

5. The precision compensation mechanism of the full-automatic bidirectional flanging machine according to claim 1, wherein the upper opening of the C-shaped flanging beam is provided with a top L-shaped mounting groove, an upper die mounting groove and an upper inner side L-shaped mounting groove, wherein the top L-shaped mounting groove is arranged at the top of the upper opening and configured for mounting the upper die Y-direction fine adjustment assembly, and each adjusting threaded sleeve and each adjusting screw of the upper die Y-direction fine adjustment assembly are positioned in the Y direction; the upper die mounting groove is arranged on the lower outer side of the upper opening and configured for threading the upper die; the upper inner side L-shaped mounting groove is arranged on the lower inner side of the upper opening and configured for mounting the upper die X-direction fine adjustment assembly, and each adjusting threaded sleeve and each adjusting screw of the upper die X-direction fine adjustment assembly are positioned in the X direction.

6. The precision compensation mechanism of the full-automatic bidirectional flanging machine according to claim 5, wherein the lower opening of the C-shaped flanging beam is provided with a bottom L-shaped mounting groove, a lower die mounting groove and a lower inner side L-shaped mounting groove, wherein the bottom L-shaped mounting groove is arranged at the bottom of the lower opening and configured for mounting the lower die Y-direction fine adjustment assembly, and each adjusting threaded sleeve and each adjusting screw of the lower die Y-direction fine adjustment assembly are positioned in the Y direction; the lower die mounting groove is arranged on the upper outer side of the lower opening and configured for threading the lower die; the lower inner side L-shaped mounting groove is arranged on the upper inner side of the lower opening and configured for mounting the lower die X-direction fine adjustment assembly, and each adjusting threaded sleeve and each adjusting screw of the lower die X-direction fine adjustment assembly are positioned in the X direction.

* * * * *